US006755508B2

(12) United States Patent
Doi

(10) Patent No.: US 6,755,508 B2
(45) Date of Patent: Jun. 29, 2004

(54) IMAGE FORMING METHOD, IMAGE FORMING APPARATUS, AND A SET OF INKS AND LIQUID COMPOSITION

(75) Inventor: Takatsugu Doi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/352,158

(22) Filed: Jan. 28, 2003

(65) Prior Publication Data

US 2003/0151643 A1 Aug. 14, 2003

(30) Foreign Application Priority Data

Jan. 29, 2002 (JP) ..... 2002-020021

(51) Int. Cl.[7] ..... B41J 2/21

(52) U.S. Cl. ..... 347/43; 347/37; 347/15; 347/100

(58) Field of Search ..... 347/43, 15, 37, 347/100, 16, 105, 14, 41

(56) References Cited

U.S. PATENT DOCUMENTS 6,682,170 B2 * 1/2004 Hotomi et al. ..... 347/43

FOREIGN PATENT DOCUMENTS

JP A 11-115303 4/1999

* cited by examiner

*Primary Examiner*—Lamson Nguyen
(74) *Attorney, Agent, or Firm*—Oliff & Berridge, PLC

(57) ABSTRACT

Provided is an image forming method excellent in reduction in color unevenness, optical density unevenness, bleeding, inter-color bleeding, a drying time, caused by the printing order; and an image forming apparatus excellent in adaptability to a higher speed. The image forming method and the image forming apparatus are characterized by use of an ink-set, wherein an average value of rates of change over time in contact angle of the respective inks on plain paper is from 1.25 to 3.5 degrees/sec, a rate of change over time in contact angle of each ink on plain paper is less than 4.5 degrees/sec, a rate of change over time in contact angle of a mixed liquid of each ink and the liquid composition on plain paper is from 5 to 10 degrees/sec and the number of coarse particles each of 5 $\mu$m or more in diameter in the mixed liquid is $1\times10^4$ particles/$\mu$L or more.

13 Claims, 3 Drawing Sheets

IMAGE FORMING METHOD, IMAGE FORMING APPARATUS, AND A SET OF INKS AND LIQUID COMPOSITION

BACKGROUND OF THE INVENTION

1. Field of the Invention

The present invention relates to an image forming method and an image forming apparatus, both adopting an ink-jet recording technique.

2. Description of the Related Art

A so-called ink-jet printer expelling an ink such as a liquid, molten solid or the like from an ink expelling egress such as a nozzle, a slit, a porous film or the like has been well employed as a commercially available printer since it can be down-sized and is not expensive and for other reasons. Known among ink-jet printers are a piezo ink-jet technique in which an ink is expelled using deformation of a piezoelectric element, a thermal ink-jet technique in which a boiling phenomenon of an ink by heat energy is used, or the like technique for reasons of a high resolution, a high speed printability and the like. The above ink-jet printers have been used in printing not only on so-called paper such as plain paper, ink-jet only paper and the like, but also on a film such as an OHP sheet, a cloth or the like as a recording medium.

Now, high speed printing is demanded in an ink-jet printing technique. As one of means effective for realizing high speed printing, there can be named bidirectional collective printing in which printing is performed in forward and return transits of a carriage motion to print pixels in a single scan. In the bidirectional collective printing technique, the printing order of inks is reversed during each scan; therefore, color unevenness caused by the printing order occurs that a hue alters during each scan in an image formed by superimposing plural colored inks one on another. Though this mechanism has not become clear, it is thought that the unevenness originates from a penetrating property of an ink into paper, overlapping between inks or the like.

On the other hand, a method has been proposed in which a treatment liquid (a liquid or a reactive liquid) other than an ink is used for the purpose to improve image quality, better print dryability and the like. For example, a method is publicly disclosed in Japanese Patent No. 2667401 and the like, in which after a liquid including a compound having a cationic group therein is deposited on a recording medium, the liquid then penetrates into the recording medium and stays therein and immediately after the liquid deposit disappears on a surface of the medium, an ink including an anionic dye is deposited onto the surface to form an image. This purports to earn not only dryability, water resistance and light resistance of a printed image, but also a high image quality concerning resolution, clearness, sharpness, image density and the like and further, to improve reliability of a printer such as prevention of nozzle clogging.

Furthermore, a method is disclosed in Japanese Patent Application Laid-Open (JP-A) No. 11-115303 and the like, in which an ink-jet recording technique is adopted in which a reactive liquid is deposited on a recording medium after an ink composition is applied thereon and an interval between coating of the ink composition and the reactive liquid is 5 ms or more and 500 ms or less. This purports to ensure an image having an improved print quality and an increased line width.

SUMMARY OF THE INVENTION

In a case of forming an image having at least a secondary color (in the present application, the phrase "having at least a secondary color" denotes having at least one of a secondary color and tertiary color) at high speed in a technique using inks and a liquid other than the inks or a reactive liquid (a treatment liquid), it has been found that color unevenness and solid color density unevenness is seen due to the printing order of the inks and the treatment liquid. While the mechanism of the unevenness deterioration has not become clear yet, the mechanism is thought to be as follows.

That is to say, in the case where printing performed by printing the treatment liquid, followed by printing at least two colors of ink, colorants coheres and the cohered colorants are stacked in a layered structure according to the printing order. Thus, it is thought that the reason for the unevenness deterioration is because the influence of the hue of the ink, which is printed last, is strong for the hue of secondary colors. In another case where printing is performed with at least two colors of ink, followed by printing of the treatment liquid, if inks with high penetrating property are used, the inks penetrate into the recording medium when printing is performed with the treatment liquid because of high speed penetration of the inks. Therefore, a sufficient effect from a reaction between the inks and the treatment liquid cannot be sufficiently obtained, reducing an improvement to image quality. In addition, color unevenness caused by the printing order also occurs. On the other hand, when inks with a low penetrating property are employed, a surface tension of the inks is large, causing the inks to form a liquid droplet on the recording medium. Thus, portions, at which ink is present, and portions, at which ink is absent, are formed. Therefore, it is supposed that solid color density unevenness tends to worsen.

In a conventional method, in the case where at least two colors of ink and a liquid or a reactive liquid are used, increased image quality, such as improved color unevenness, optical density, bleeding, and inter-color breeding, and higher speed, such as improved drying time, cannot be accomplished simultaneously.

The present invention is intended to solve the above problems in the prior art and achieves the following object as a task. That is, an object of the invention is to provide an image forming method excellent in reduction of color unevenness, optical density unevenness, bleeding, inter-color bleeding, a drying time and the like, caused by the printing order; and an image forming apparatus excellent in applicability to higher speeds.

In order to solve the above task, a serious study has been conducted and as a result, it has been found that in order to simultaneously achieve reduction in color unevenness, optical density unevenness, bleeding, inter-color bleeding, a drying time and the like, caused by the printing order, the printing order of the ink and a liquid composition having a function of cohering the ink, and a penetrating property of the inks into paper are very important, thus achieving the invention.

According to the first aspect the invention, the invention is an image forming method comprising the steps of:

printing at least two colors of ink onto a recording medium using an ink-set, which satisfies the below conditions (i) to (iv) and includes the at least two colors of ink and a liquid composition including an effect of cohering the at least two colors of ink; and forming an image, which includes a pattern of at least a secondary color, by printing the liquid composition on the printed ink, wherein (i) an average value of rates of change over time in contact angle of the respective inks on plain paper is at least 1.25 degrees/sec and no more than 3.5 degrees/sec, (ii) a rate of change over time for a contact angle of each ink on plain paper is less than 4.5 degrees/sec, (iii) a rate of change over time for a contact angle of a mixture of each ink and the liquid composition on plain paper is in the range of from 5 to 10 degrees/sec and (iv) the number of coarse particles, which have a diameter of at least 5 $\mu$m, in the mixture is at least $1\times10^4$ particles/$\mu$L.

According to the second aspect of the invention, the invention is an image forming method, wherein a surface tension of each of the inks is at least 25 mN/m and no more than 40 mN/m.

According to the third aspect of the invention, the invention is an image forming method, wherein a viscosity of each of the inks is at least 1.5 mPa·s and no more than 6.0 mPa·s.

According to another aspect of the invention, the invention is an image forming method, wherein a recording head reciprocates along a direction intersecting with a conveyance direction of the recording medium to form an image by adhering the at least two colors of ink on the recording medium, and prints in both forward transit and return transit with the at least two colors of ink, and then prints the liquid composition on the ink printed on the recording medium to form the image including a pattern of at least a secondary color.

According to another aspect of the invention, the invention is an image forming method, wherein an image is formed with a thermal ink-jet technique.

According to another aspect of the invention, the invention is an image forming apparatus comprising:

an ink set, which satisfies the below conditions (i) to (iv) and includes at least two colors of ink and a liquid composition including an effect of cohering the at least two colors of ink;

an ink recording head for printing at least one color of ink, by discharging the at least one color of ink onto a recording medium;

a plurality of liquid composition recording heads for printing the liquid composition on the printed ink, wherein the liquid composition heads are disposed at both ends of the ink recording head in a main scanning direction of the ink recording head, and (i) an average value of rates of change over time in contact angle of the respective inks on plain paper is at least 1.25 degrees/sec and no more than 3.5 degrees/sec, (ii) a rate of change over time for a contact angle of each ink on plain paper is less than 4.5 degrees/sec, (iii) a rate of change over time for a contact angle of a mixture of each ink and the liquid composition on plain paper is in the range of from 5 to 10 degrees/sec and (iv) the number of coarse particles, which have a diameter of at least 5 $\mu$m, in the mixture is at least $1\times10^4$ particles/$\mu$L.

According to another aspect of the invention, the invention is an image forming apparatus, wherein a surface tension of each of the inks is at least 25 mN/m and no more than 40 mN/m.

According to another aspect of the invention, the invention is an image forming apparatus, wherein a viscosity of each of the inks is at least 1.5 mPa·s and no more than 6.0 mPa·s.

According to another aspect of the invention, the invention is an image forming apparatus, wherein the image forming apparatus reciprocates along a direction intersecting with a conveyance direction of the recording medium to form an image by adhering the at least two colors of ink on the recording medium, and prints in both forward transit and return transit, then prints the liquid composition on the ink printed on the recording medium to form an image including a pattern of at least a secondary color.

According to another aspect of the invention, the invention is an image forming apparatus, wherein the image is formed with a thermal ink-jet technique.

According to another aspect of the invention, the invention is a set of inks and liquid composition, wherein the inks satisfy the below conditions (i) to (iv) and includes the at least two colors of ink and the liquid composition including an effect of cohering the at least two colors of ink, (i) an average value of rates of change over time in contact angle of the respective inks on plain paper is at least 1.25 degrees/sec and no more than 3.5 degrees/sec, (ii) a rate of change over time for a contact angle of each ink on plain paper is less than 4.5 degrees/sec, (iii) a rate of change over time for a contact angle of a mixture of each ink and the liquid composition on plain paper is in the range of from 5 to 10 degrees/sec and (iv) the number of coarse particles, which have a diameter of at least 5 $\mu$m, in the mixture is at least $1\times10^4$ particles/$\mu$L.

According to another aspect of the invention, the invention is a set of inks and a liquid composition, wherein a surface tension of each of the inks is at least 25 mN/m and no more than 40 mN/m.

According to another aspect of the invention, the invention is a set of inks and a liquid composition according to claim 11, wherein a viscosity of each of the inks is at least 1.5 mPa·s and no more than 6.0 mPa·s.

DESCRIPTION OF THE PREFERRED EMBODIMENTS

Figure 1:
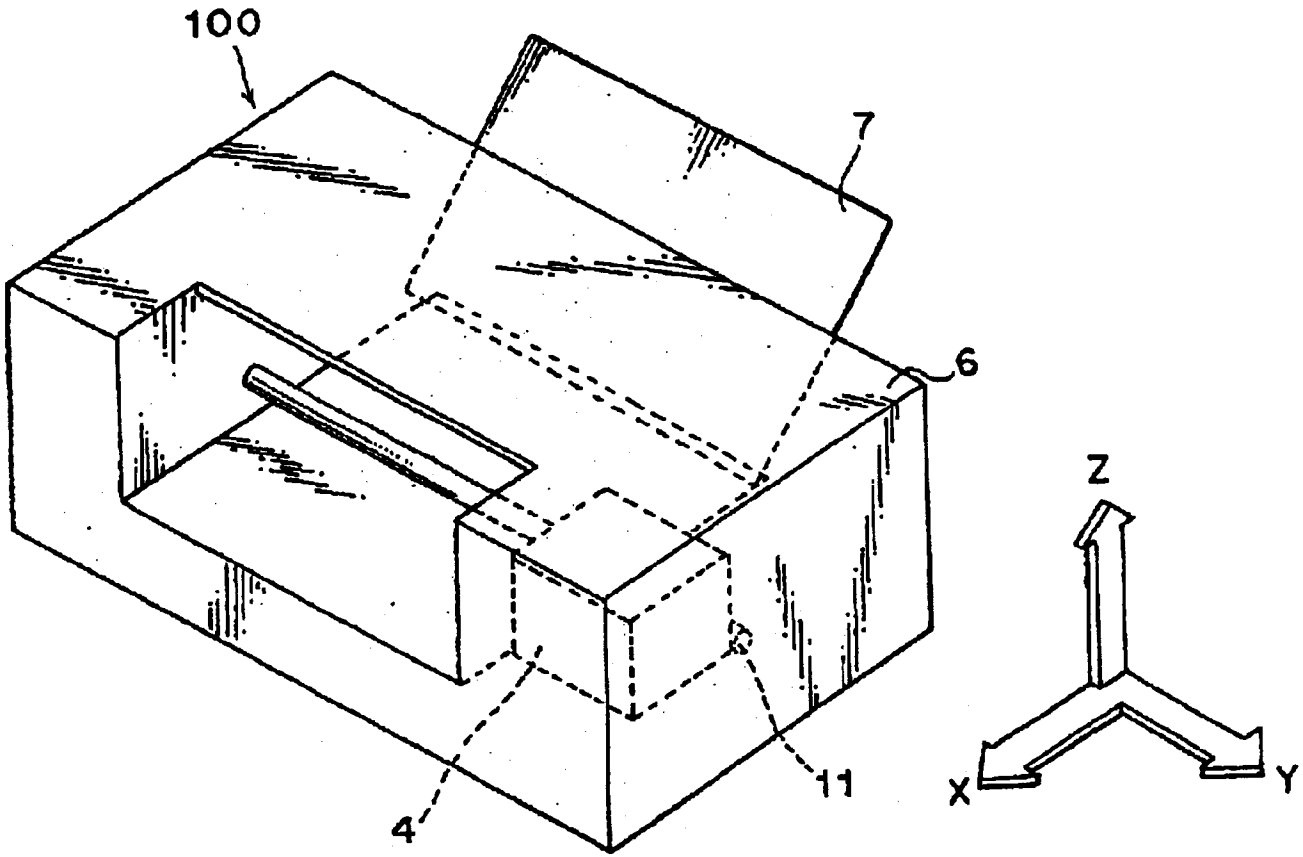
FIG. 1 is a perspective view showing a construction of outer appearance of a suitable embodiment of an image forming apparatus of the present invention.

Detailed description will be given of the present invention below.

An image forming method of the invention is characterized by that an ink set, composed of inks in at least two colors and a liquid composition having a function to cohere the inks in at least two colors (hereinafter simply referred to as a "liquid composition"), and meeting the following conditions (i) to (iv) is employed to perform printing with the inks in at least two colors on a recording medium and thereafter, printing is performed on inks printed on the recording medium with the liquid composition to form an image including a pattern in at least a secondary color.

While a proposal has been made on a method using an liquid other than an ink for the purpose to improve an image quality, a degree of the improvement is insufficient in respects of the reduction of color unevenness, optical density unevenness, bleeding, inter-color bleeding associated with the printing order. Therefore, in an image forming method of the invention, a conclusion has been achieved that the liquid composition is applied after ink printing; that is to say, after inks in at least two colors are deposited on the recording medium, the liquid composition is printed on inks adhered onto the recording medium to form an image including a pattern in at least a secondary color and to thereby enable prevention of color unevenness, optical density unevenness, bleeding, inter-color bleeding, caused by the printing order. Though a mechanism thereof has not become clear yet, this is conjectured because if an ink set having a specific penetrating property is employed to adhere at least two colors of ink on a recording medium and thereafter the liquid composition is applied on the inks, the liquid composition is applied on the inks in a state that the ink remains without penetrating into the recording medium to cause the inks in each of the inks on the recording medium to penetrate into the recording medium simultaneously with the liquid composition by an action thereof.

(i) While an average value of rates of change over time in contact angle of the respective inks on plain paper is 1.25 degrees/sec or more and 3.5 degrees/sec or less, the average value is preferably 1.25 degrees/sec or more and 3.0 degrees/sec or less, and more preferably 1.5 degrees/sec or more and 2.5 degrees/sec or less. If an average value of rate of change over time in ink contact angle is in excess of 3.5 degrees/sec, color unevenness caused by the printing order is deteriorated. This is supposed because a penetrating property of each ink into plain paper is large, which causes inks on the recording medium not to remain on applying of the liquid composition thereon. On the other hand, if an average value of rates of change over time in contact angle of inks is less than 1.25 degrees/sec, solid color density unevenness occurs. This is supposed because an ink with a small rate of change over time in contact angle increases a contact angle of the ink on a recording medium and the ink forms a liquid droplet on the recording medium.

(ii) While a rate of change over time in contact angle of each ink on plain paper is less than 4.5 degrees/sec, it is more preferably in the range of from 1 to 4 degrees/sec and further more preferably in the range of from 1 to 3.5 degrees/sec. If a rate of change over time in contact angle of an ink is beyond 4.5 degrees/sec, color unevenness, optical color density unevenness and bleeding caused by the printing order are deteriorated. This is supposed because a penetrating property of the ink into plane paper is large and no ink remains on a recording medium on deposition of the liquid composition.

Herein, measurement can be conducted on a rate of change over time in contact angel (a dynamic contact angle) of an ink on plain paper in the following way: P paper and FX-L paper (made by Fuji Xerox Co., Ltd.) as plain paper are employed and 4.0 $\mu$L of an ink is placed on the plain paper to measure a time-dependent change in contact angle with FIBRO 1100 DAT MKII (made by FIBRO System). Note that in the invention, a rate of change over time in contact angle is defined as a value obtained by dividing a change in contact angle in a period from the start to 10 sec elapsed thereafter with a measurement time (10 sec). In the case where a rate of change over time in contact angle is large and a measurement time is terminated when a time less than 10 sec elapsed, a rate of change over time in contact angle is determined over an time interval till the termination.

Description will be given of a control method for a rate of change over time in contact angle of an ink on plain paper below. In general, a rate of change over time in contact angle tends to be solely determined by a surfactant added into the ink. That is to say, in the case where a surfactant with a high penetrating property is used, even if a small amount of the surfactant is added, a rate of change over time in contact angle tends to increase. Contrary to this, in the case where a surfactant with a low penetrating property is used, necessity arises for increase in an amount of the surfactant added in order to enhance a rate of change over time in contact angle.

In the case where a pigment is used as a colorant, a surfactant is adsorbed to the pigment; therefore, not only is a dispersion stability of the pigment itself reduced, but an amount of the surfactant present in an ink solvent also decreases. Adsorption to the pigment of a surfactant is considered to be controllable by a balance between hydrophilic nature and hydrophobic nature of the pigment and the surfactant and the like. Therefore, in the case where a pigment is employed as a colorant, a necessity arises for determining an ink composition including a pigment, a water-soluble solvent, a surfactant and the like in consideration of a penetrating property of the surfactant, adsorption of the surfactant to the pigment and the like. Furthermore, in the case where, as described above, a surfactant is added to a system in which a pigment is dispersed using a dispersant since a surfactant is adsorbed to a pigment, the surfactant is adsorbed to the pigment to replace the dispersant therewith. Hence, reduction in dispersion stability of a pigment occurs as a tendency. On the other hand, in the case where a pigment self-dispersible into water is employed, surface functional groups are chemically bonded onto the pigment; therefore, no replacement with the surfactant occurs and an influence on dispersion stability of the pigment tends to be smaller. For such a reason, in the case where a pigment is used as a colorant and a penetrating property is controlled by a surfactant, the pigment is preferably to be self-dispersible to water.

On the other hand, in the case where a dye is used as a colorant, an interaction between a surfactant and the dye is small; therefore, a kind and an amount to be added of the surfactant can be adjusted in consideration of a penetrating property. However, an influence arises on a micelle structure of a surfactant and the like according to a combination of a surfactant and a dye and a case arises where an influence occurs on a penetrating property of an ink; therefore, the presence or absence and a degree of the influence of a surfactant cannot be definitely described.

In order to control a rate of change over time in contact angle, as described above, there is a necessity for considering not only a kind and an amount of a surfactant, but also a kind of a colorant, amount thereof, a combination of the colorant and the surfactant and furthermore, a combination with a water-soluble organic solvent. Generally, a rate of change over time in contact angle is correlated with a penetrating property and a drying time, and there is a tendency that an ink with a large rate of change over time is large in penetrating property and short in drying time, while contrary to this, there is a tendency that an ink with a small rate of change over time is small in penetrating property and long in drying time.

(iii) While a rate of change over time in contact angle of a mixed liquid of each ink and the liquid composition on plain paper is in the range of from 5 to 10 degrees/sec, the rate is more preferably in the range of from 5 to 8 degrees/sec and further more preferably in the range of from 5.5 to 7.5 degrees/sec. If a rate of change over time in contact angle of a mixed liquid of each ink and the liquid composition is less than 5 degrees/sec, a drying time of the ink gets longer. On the other hand, if a rate of change over time in contact angle exceeds 10 degrees/sec, an optical density is low and bleeding is deteriorated.

Herein, a rate of change over time in contact angle of a mixed liquid of each ink and the liquid composition can be measured in a similar way to the measurement on a rate of change over time in contact angle (a dynamic contact angle) of the ink on plain paper using the mixed liquid, as described above, which is obtained by mixing the ink and the liquid composition at a mass ratio of 1:1.

(iv) While the number of coarse particles each of 5 $\mu$m or more in diameter in the mixed liquid of each ink and the liquid composition is $1\times10^4$ particles/$\mu$L or more, the number is more preferably $5\times10^4$ particles/$\mu$L or more and further more preferably $1\times10^5$ particles/$\mu$L or more. If the number of coarse particles each of 5 $\mu$m or more in diameter in the mixed liquid of each ink and the liquid composition is less than $1\times10^4$ particles/$\mu$L, color unevenness, optical density unevenness and bleeding are deteriorated.

Herein, the number of coarse particles each of 5 $\mu$m or more in diameter in the mixed liquid of each ink and the liquid composition can be measured by mixing each ink and the liquid composition at a mass ratio of 1:1 to sample 2 $\mu$L of a mixed liquid while agitating with Accusizer ™770 Optical Particle Sizer (made by Particle Sizing Systems).

Note that a density of a colorant is inputted to a density of dispersed particles as a parameter in measurement. A density of colorant can be determined by measuring powder obtained by heat drying a dye aqueous solution or a pigment aqueous solution with a gravimeter or a specific gravity bottle.

Detailed description will be given of an ink.

A surface tension of each of the inks is preferably 25 mN/m or more and less than 40 mN/m, and more preferably 27.5 mN/m or more and less than 40 mN/m, and further more preferably 30 mN/m or more and less than 37.5 mN/m. If the surface tension is less than 25 mN/m, penetration of an ink is faster and a case arises where color unevenness, optical density unevenness and bleeding caused by the printing order are deteriorated. Contrary to this, if the surface tension is more than 40 mN/m, penetration of an ink is slower and a case arises where solid color density unevenness occurs.

A viscosity of each of the inks is preferably 1.5 mPa·s or more and 6.0 mPa·s or less, and more preferably in a range of from 1.5 mPa·s to 4.0 mPa·s. If a viscosity of an ink is more than 6.0 mPa·s, an ink expelling property decreases to thereby have a chance to lose reliability. On the other hand, if a viscosity of an ink is less than 1.5 mPa·s, a chance arises that a sufficient optical density is not obtainable. This is considered because a penetrating property to plain paper is enhanced to cause a colorant to penetrate into the plain paper.

As colorants used in an ink, either of a pigment and a dye can be employed. As for pigments, either of an organic pigment and an inorganic pigment can be used and as black pigments, there can be named: carbon black pigments such as furnace black, lamp black, acetylene black and channel black. There may be used: in addition to a black pigment and three primary colors pigments including cyan, magenta and yellow; special color pigments such as those in red, green, blue, brown, white and the like; metallic luster pigment such as gold, silver and the like; extender pigment such as an achromatic color or a pale color; plastic pigments; and the like. Moreover, a pigment newly synthesized for the invention may be employed.

As specific examples, there can be named: pigments from Columbian Chemicals Company including Raven 7000, Raven 5750, Raven 5250, Raven 5000, ULTRAII, Raven 3500, Raven 2000, Raven 1500, Raven 1250, Raven 1200, Raven 1190, ULTRAI1, Raven 1170, Raven 1255, Raven 1080 and Raven 1060; pigments from Cabot Corporation including Regal 1400R, Regal 1330R, Regal 1660R, Mogul L, Black Pearls L, Monarch 700, Monarch 800, Monarch 880, Monarch 900, Monarch 1000, Monarch 1100, Monarch 1300 and Monarch 1400; pigments from Degussa Corporation including Color Black FW1, Color Black FW2, Color Black FW2V, Color Black 18, Color Black FW200, Color Black S150, Color Black S160, Color Black S170, Printex 35, Printex U, Printex V, Printex 140U, Printex 140V, Special Black 6, Special Black 5, Special Black 4A and Special Black 4; and pigments from Mitsubishi Chemical Co., Ltd. including No. 25, No. 33, No. 40, No. 47, No. 52, No. 900, No., 2300, MCF-88, MA 600, MA 7, MA8 and MA 100; and the like, to which no specific limitation is placed.

As pigments in cyan color, there can be named C. I. Pigment Blue -1, -2, -3, -15, -15 : 1, -15 : 2-15 : 3,-15 : 4,, -16, -22, -60 and the like to which no specific limitation is placed.

As pigments in magenta color, there can be named C. I. Pigment Red -5, -7, -12, -48, -48 : 1, -57, -112, -122, -123, -146, -168, -184, -202 and the like, to which no specific limitation is placed.

As pigments in yellow color, there can be named C. I. Pigment Yellow -1, -2, -3, -12, -13, -14, -16, -17, -73, -74, -75, -83, -93, -95, -97, -98, -114, -128, -129, -138, -151, -154 and the like, to which no specific limitation is placed.

As for a pigment, there can also be used a pigment self-dispersible in water. A pigments self-dispersible in water is a pigment having many water-soluble groups on the surface thereof and capable of stably dispersing in water without the presence of a high molecular dispersant. A pigment self-dispersible in water, specifically, can be obtained by giving a so-called pigment, which is common, a surface modification treatment such as an acid-base treatment, a coupling agent treatment, polymer grafting treatment, a plasma treatment, an oxidation/reduction treatment or the like.

Furthermore, as pigments self-dispersible in water, in addition to the above pigments receiving a surface modification treatment, there can be used: pigments from Cabot Corporation including Cab-o-jet-200, Cab-o-jet-300; IJX-253, IJX-266, IJX-444, IJX-273 and IJX-55; pigments from Orient Chemical Industries, Ltd. including Microjet Black CW-1 and CW-2; and self-dispersible pigments sold by Nippon Shokubai Co., Ltd., which are self-dispersible pigments on the market.

As for dyes, any of water-soluble dyes and disperse dyes may be used. As specific examples, there can be named: C. I. Direct Black -2, -4, -9, -11, -17, -19, -22, -32, -80, -151, -154, -168, -171, -194 and -195; C. I. Direct Blue -1, -2, -6, -8, -22, -34, -70, -71, -76, -78, -86, -112, -142, -165, -199, -200, -201, -202, -203, -207, -218, -236, -287 and -307; C. I. Direct Red -1, -2, -4, -8, -9, -11, -13, -15, -20, -28, -31, -33, -37, -39, -51, -59, -62, -63, -73, -75, -80, -81, -83, -87, -90,-94, -95, -99, -101, -110, -189 and -227; C. I. Direct Yellow -1, -2, -4, -8, -11, -12, -26, -27, -28, -33, -34, -41, -44, -48, -58, -86, -87, -88, -132, -135, -142, -144 and -173; C.

I. Food Black -1 and -2; C. I. Acid Black -1, -2, -7, -16, -24, -26, -28, -31, -48, -52, -63, -107, -112, -118, -119, -121, -156, -172, -194 and -208; C. I. Acid Blue -1, -7, -9, -15, -22, -23, -27, -29, -40, -43, -55, -59, -62, -78, -80, -81, -83, -90, -102, -104, -111, -185, -249 and -254; C. I. Acid Red -1, -4, -8, -13, -14, -15, -18, -21, -26, -35, -37, -52, -110, -144, -180, -249, -257 and -289; C. I. Acid Yellow -1, -3, -4, -7, -11, -12, -13, -14, -18, -19, -23, -25, -34, -38, -41, -42, -44, -53, -55, -61, -71, -76, -78, -79 and -122; and the like.

As specific examples of disperse dyes, there can be named: C. I. Disperse Yellow -3, -5, -7, -8, -42, -54, -64, -79, -82, -83, -93, -100, -119, -122, -126, -160, -184 : 1, -186, -198, -204 and -224; C. I. Disperse Orange -13, -29, -31: 1, -33, -49, -54, -66, -73, -119 and -163; C. I. Disperse Red -1, -4, -11, -17, -19, -54, -60, -72, -73, -86, -92, -93, -126, -127, -135, -145, -154, -164, -167 : 1, -177, -181, -207, -239, -240, -258, -278, -283, -311, -343, -348, -356 and -362; C. I. Disperse Violet -33; C. I. Disperse Blue -14, -26, -56, -60, -73, -87, -128, -143, -154, -165, -165 : 1, -176, -183, -185, -201, -214, -224, -257, -287, -354, -365 and -368; C. I. Disperse Green -6 : 1 and -9; and the like.

A colorant is preferably used in the range of from 0.5 to 20% by mass of an ink and preferably in the range of from 1:10% by mass of the ink. If an amount of a colorant in an ink is less than 0.5 mass %, a chance occurs that a sufficient optical density cannot be obtained, while if an amount of a colorant in an ink is more than 20 mass %, an ink spouting property has a chance to become unstable.

No problem arises even if a high molecular dispersant is added together with a colorant in order to disperse a colorant (especially, a pigment). As high molecular dispersants, there can be used: a nonionic compound, an anionic compound, a cationic compound, an ampholytic compound and the like, for example a copolymer of monomers having α, β-ethylenic unsaturated group, and the like.

Specifically, there can be named as monomers having α, β-ethylenic unsaturated group: acrylic acid, methacrylic acid, crotonic acid, itaconic acid, itaconic acid monoester, maleic acid, maleic acid monoester, fumaric acid, fumaric acid monoester, vinylsulfonic acid, styrene sulfonic acid, sulfonated vinylnaphthalene, vinyl alcohol, acrylic amide, methacryloxyethyl phosphate, bismethacryloxyethyl phosphate, methacryloxyethylphenyl acid phosphate, ethyleneglycol dimethacrylate, diethyleneglycol dimetacrylate, styrene, styrene derivatives such as α-methylstyrene, vinyltoluene and the like, vinylcyclohexane, vinylnaphthalene, vinylnaphthalene derivatives, an alkylester of acrylic acid, a phenylester of acrylic acid, an alkylester of methacrylic acid, a phenylester of methacrylic acid, a cycloalkylester of methacrylic acid, an alkylester of crotonic acid, a dialkylester of itaconic acid, a dialkylester of maleic acid and the like.

Used as high molecular dispersants are polymers obtained by polymerization of monomers of a single kind each with α, β-ethylenic unsaturated group or copolymers obtained by copolymerization of monomers of plural kinds each with α, β-ethylenic unsaturated group. Specifically, polyvinyl alcohol, polyvinyl pyrrolidone, styrene—styrene sulfonic acid copolymer, styrene-maleic acid copolymer, styrene-methacrylic acid copolymer, styrene-acrylic acid copolymer, vinylnaphthalene-maleic copolymer, vinylnaphthalene-methacrylic acid copolymer, vinylnaphthalene-acrylic acid copolymer, an alkylester of acrylic acid-acrylic acid copolymer, an alkylester of methacrylic acid-methacrylic acid copolymer, a styrene-alkylester of methacrylic acid-methacrylic acid copolymer, a styrene-alkylester of acrylic acid-acrylic acid copolymer, styrene-phenylester of methacrylic acid-methacrylic acid copolymer, styrene-cyclohexylester of methacrylic acid-methacrylic acid copolymer and the like.

A high molecular dispersant is preferably in the range of from 2000 to 15000 in weight-average molecular weight and further more preferably in the range of from 3500 to 10000 in weight-average molecular weight. If a molecular weight of a high molecular dispersant is less than 2000, a chance arises that a pigment is not stably dispersed, while if the molecular weight exceeds 15000, a viscosity of an ink increases to deteriorate an expelling property.

An amount of a high molecular dispersant added into an ink is preferably in the range of from 0.1 to 3% by mass of the ink. If the added amount exceeds 3 mass %, a viscosity of the ink increases, an ink spouting property has a chance to become unstable. On the other hand, if the added amount is less than 0.1 mass %, a chance arises that dispersion stability of a pigment decreases. As an added amount of a high molecular dispersant is more preferably in the range of from 0.15 to 2.5% by mass of the ink and further more preferably in the range of from 0.2 to 2% by mass of the ink.

As water-soluble organic solvents used in inks, there are named: a polyhydric alcohol, a polyhydric alcohol derivative, a nitrogen containing solvent, alcohols, sulfur containing solvent and the like. As specific examples, there are named in polyhydric alcohols, ethylene glycol, diethylene glycol, propylene glycol, butylene glycol, triethylene glycol, 1,5-pentanediol, 1,2,6-hexanetriol, glycerin, and the like. As polyhydric alcohol derivertives, there are named ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, diglyicerine with ethylene oxide adduct and the like. As nitrogen containing solvent, there are named: pyrrolidone, N-methyl-2-pyrrolidone, cyclohexylpyrrolidone, triethanol amine and the like; as aslcohols, there are named: ethanol, isopropyl alcohol, butyl alcohol, benzyl alcohol and the like; and as sulfur, there are named: thiodiethanol, thiodiglicerol, sulfolane, dimethyl sulfoxide and the like. In addition, there can also be employed: propylene carbonate, ethylene carbonate and the like.

At least one kind of water-soluble organic solvents is preferably used. A content of a water-soluble organic solvent is generally in the range of from 1 to 60% by mass of an ink and preferably in the range of from 5 to 40 mass %. If a water-soluble organic solvent in an ink is less than 1 mass %, a chance arises that a sufficient optical density is not obtained, while to the contrary, if a water-soluble organic solvent is more than 60 mass %, a viscosity of the ink increases to cause an ink spouting property to be unstable.

A surfactant can be used in an ink without causing a problem. As a surfactant, there can be used a compound of a structure including a hydrophilic part and a hydrophobic part in a molecule and there can be used without causing a problem, any of an anionic surfactant, a cationic surfactant, an amphoteric surfactant and a nonionic surfactant. Furthermore, the high molecular dispersants can also be used as surfactants.

As anionic surfactants, there can be used: an alkylbenzene sulfonic acid salt, an alkylphenyl sulfonic acid salt, an alkylnaphthalene sulfonic acid salt, a higher fatty acid salt, a sulfuric acid ester salt of a higher fatty acid ester, a sulfonic acid salt of a higher fatty acid ester, a sulfuric acid ester salt and a sulfonic acid salt of a higher alcohol ether, a higher alkyl sulfosuccinic acid salt, a higher alkykl phosphoric acid ester salt, a phosphoric acid ester salt of a higher alcohol ethylen oxide adduct and the like; for example, dodecylbenzene sulfonic acid salt, allylbenzene sulfonic acid salt, isopropylnaphthalene sulfonic acid salt, monobutylphenylphenol monosulfonic acid salt, monobutylbiphenyl sulfonic acid salt, monobutylbiphenyl sulphonic acid salt, dibutylphenylphenol disulfonic acid salt and the like, which are also effectively used.

As nonionic surfactants, there are named: an ethylene oxide adduct of polypropylene glycol, polyoxyethylene nonylphenyl ether, polyoxyethylene octylphenyl ether, polyoxyethylene dodecylphenyl ether, a polyoxyethylene alkyl ether, polyoxyehylene fatty acid ester, sorbitan fatty acid ester, polyoxyehtylene sorbitan fatty acid ester, a fatty acid alkylol amide, acetylene glycol, an oxyethylene adduct of acethylene glycol, aliphatic alkanol amide, glycerin ester, sorbitan ester and the like.

As cationic surfactants, there are named: a tetra-alkyl ammonium salt, an alkylamine salt, a benzalkonium salt, an alkyl pyridinium salt, an imidazolium salt and the like, for example dihydroxyethyl stearyl amine, 2-heptadicenylhydroxyethyl imidazoline, lauryldimethylbenzyl ammonium chloride, cetylpyridinium chloride, stearamidmethylpyridinium chloride and the like.

In addition, there can be used: a silicone base surfactant such as a polysiloxane oxyethylene adduct and the like; fluorine containing surfactant such as perfluoroalkyl carboxylic acid salt, perfluoroalkyl sulfonic acid salt, an oxyethylene perfluoroalkyl ether and the like; and biosurfactant such as spiculisporic acid, rhamnolipid, lysolecithin and the like.

As surfactants, a nonionic surfactant or an anionic surfactant are preferable from the view point of dispersion stability of a colorant since a solubilizing group of a colorant is generally of an anionic property. Furthermore, acetylene glycol, an oxyethylene adduct of an acetylene glycol, a polyoxyethylene alkyl ether and the like are preferable from the view point of penetrating property control.

An added amount of a surfactant is preferably in content less than 10% by mass of an ink and more preferably in the range of from 0.01 to 5 mass % by mass of the ink and further preferably in the range of from 0.01 to 3% by mass of the ink. If the added amount is more than 10 mass %, a chance arises that an optical density and storage stability of a pigment ink are deteriorated.

For the purpose to control characteristics of a ink such as improvement on an ink expelling property, there can be used in addition to the above described materials: polyethylene imine, polyamines, polyvinyl pyrrolidone, polyethylene glycol, cellulose derivatives such as ethyl cellulose, carboxymethyl cellulose and the like, polysaccharides and derivative thereof, in addition, a water-soluble polymer, polymer emulsions such as an acrylic polymer emulsion, polyurethane emulsion and the like, cyclodextrin, macrocyclic amines, dendrimer, crown ethers, urea and a derivative thereof, acetoamide and the like. Furthermore, in order to adjust a conductivity and a pH value, there can be used: compounds of alkali metals such as potassium hydroxide, sodium hydroxide, lithium hydroxide and the like; nitrogen containing compounds such as ammonium hydroxide, triethanol amine, diethanol amine, ethanol amine, 2-amino-2-methgyl-1-propanol and the like; compounds of alkali earth metals such as calcium hydroxide and the like; acids such as sulfuric acid, hydrochloric acid, nitric acid and the like; and a salt of a strong acid and a weak alkali such as ammonium sulfate and the like. Moreover, there can be added to an ink as necessary: a pH buffer, an antioxidant, a fungicide, a viscosity modifier, an electrical conductivity imparting agent, an ultraviolet absorber and a chelating agent and the like.

Further detailed description will be given of a liquid composition having a function to cohere an ink.

As liquid compositions to cohere an ink, any of liquid compositions can be used as far as they each includes a compound to react with a specific component in an ink to form a water-insoluble product. For an ink containing a colorant on the surface of which has an anionic group, a liquid composition preferably contains an electrolyte, a cationic compound or the like. Furthermore, a method is also effective in which a pH value is adjusted to reduce. As electrolytes used effectively in the invention, there can be named: alkali metal ions such as a lithium ion, a sodium ion, a potassium ion and the like; and multivalent metal ion such as an aluminum ion, a barium ion, a calcium ion, a copper ion, an iron ion, a magnesium ion, a magnesium ion, a nickel ion, a tin ion, a titanium ion, a zinc ion and the like; hydrochloric acid, hydrobromic acid, hydroiodic acid, sulfuric acid, nitric acid, phosphoric acid, thiocyanic acid; organic carboxylic acids such as acetic acid, oxalic acid, lactic acid, fumalic acid, citric acid, salicylic acid, benzoic acid and the like; and a salt of an organic sulfonic acid and the like.

As specific examples, there can be named: salts of alkali metals such as lithium chloride, sodium chloride, potassium chloride , sodium bromide, potassium bromide, sodium iodide, potassium iodide, sodium sulfate, potassium nitrate, sodium acetate, potassium oxalate, sodium citrate, potassium benzoate and the like; and salts of multivalent metals such as aluminum chloride, aluminum bromide, aluminum sulfate, aluminum nitrate, sodium aluminum sulfate, potassium aluminum sulfate, aluminum acetate, barium chloride, barium bromide, barium iodide, barium oxide, barium nitrate, barium thiocyanate, calcium chloride, calcium bromide, calcium iodide, calcium nitrite, calcium nitrate, calcium dihydrogenphosphate, calcium thiocyanate, calcium benzoate, calcium acetate, calcium salicylate, calcium tartrate, calcium lactate, calcium fumalate, calcium citrate, copper chloride, copper bromide, copper sulfate, copper nitrate, copper acetate, iron chloride, iron bromide, iron iodide, iron sulfate, iron nitrate, iron oxalate, iron lactate, iron fumalate, iron citrate, magnesium chloride, magnesium bromide, magnesium iodide, magnesium sulfate, magnesium nitrate, magnesium acetate, magnesium lactate, manganese chloride, manganese sulfate, manganese nitrate, manganese dihydrogenphosphate, manganese acetate, manganese salicylate, manganese benzoate, manganese lactate, nickel chloride, nickel bromide, nickel sulfate, nickel nitrate, nickel acetate, tin sulfate, titanium sulfate, zinc chloride, zinc bromide, since sulfate, zinc nitrate, zinc thiocyanate, zinc acetate and the like.

Furthermore, as cationic compounds, there can be named primary, secondary, tertiary and quarternary amines and salts thereof. As specific examples, there can be named: a tetra-alkyl ammonium salt, an alkyl amine salt, a benzalkonium salt, an alkyl pyridinium salt, an imidazolium salt, polyamine and the like, for example isopropylamine, isobutylamine, t-butylamine, 2-ethylhoxylamine, nonylamine, dipropylamine, diethylamine, trimethylamine, triethylamine, dimethylpropylamine, ethylene diamine, propylene diamine, hexamethylene diamine, diethylene triamine, tetraethylene pentaamine, diethanolamine, diethylethanolamine, triethanolamine, tetramethyl ammonium chloride, tetraethyl ammonium bromide, dihydroxyethylstearyl amine, 2-heptadecenyl-hydroxyethyl imidazoline, lauryldimethylbenzyl ammonium chloride, cetylpyridinium chloride, stearamidmethylpyridinium chloride, diallyldimethyl ammonium chloride polymer, diallyamine polymer, monoallylamine polymer and the like.

As preferable electrolytes, there can be named: aluminum sulfate, calcium chloride, calcium nitrate, calcium acetate, magnesium chloride, magnesium nitrate, magnesium sulfate, magnesium acetate, tin sulfate, zinc sulfate, zinc nitrate, zinc sulfate, zinc acetate, aluminum nitrate, monoallylamine polymer, diallylamine polymer, diallyldimethyl ammonium chloride polymer and the like.

On the other hand, for an ink containing a colorant having a cationic group on the surface thereof, it is preferable for the ink to contain an anionic compound or the like in a liquid composition. Furthermore, it is also effective to adjust a pH value of a liquid composition to a higher value. As anionic compounds effectively used in the invention, there can be named: an organic carboxylic acid or an organic sulfonic acid and salts thereof. Specifically, as organic carboxylic acids, there can be named: acetic acid, oxalic acid, lactic acid, fumalic acid, citric acid, salicyic acid, benzoic acid and the like and an olygomer or a poylmer having plural fundamental structures described above can be used without causing a problem. Furthermore, as organic sulfonic acids, there can be named: benzene sulfonic acid, toluene sulfonic acid and other compounds and an oligomer or a polymer having the plural fundamental structures can be used without causing a problem.

A surface tension of a liquid composition is preferably 20 mN/m or more and less than 55 mN/m. If the surface tension is less than 20 mN/m, a chance arises that an expelling property becomes unstable. This is supposed because an ink brims over the tip of a nozzle, giving an adverse influence on the ink expelling property. On the other hand, if the surface tension is equal to or more than 55 mN/m, a chance arises that dryability is reduced.

A viscosity of a liquid composition is desirably 1.5 mPa·s or more and 6.0 mPa·s or less. It a viscosity of a liquid composition exceeds 6.0 mPa·s, an expelling property of an ink decreases, leading to a chance of reduction in reliability. On the other hand, if a viscosity of an ink is less than 1.5 mPa·s, a chance arises that long term preservability is reduced.

In an image forming method of the invention, a liquid composition is preferably applied on an ink in the range of from 0.1 to 2 in mass ratio to the ink.

In an image forming method of the invention, while printing is performed with inks of at least two colors on a recording medium and thereafter, a liquid composition is deposited on inks printed on the recording medium to form an image including a pattern of at least a secondary color, a thermal ink-jet recording technique is preferably adopted from the view point of an effect of reduction in bleeding and inter-color-bleeding. Though a cause for the effect has not become clear, an ink is heat reduced in viscosity when the ink is expelled and its temperature falls on the recording medium with the result of a rapid increase in viscosity. Therefore, the improving effect is thought to work on prevention of bleeding and inter-color bleeding.

An image forming method of the invention, in the case where a recording head reciprocates along a direction (a main scanning direction) intersecting with a feed direction of a recording medium (a secondary scanning direction) to perform printing with inks and a liquid composition and form an image (the bidirectional collective printing technique), printing is performed in forward and return transits with inks at least two colors, thereafter, printing is further performed on inks printed on the recording medium with the liquid composition to form an image including a pattern of at least a secondary color, thereby enabling reduction in color unevenness, optical density unevenness, bleeding and inter-color bleeding together with reduction in drying time and therefore, improvement on high speed adaptability.

As an image forming apparatus applied to an image forming method of the invention, there are exemplified: a common ink-jet recording apparatus; in addition thereto, a recording apparatus equipped with a heater or the like for controlling drying of inks; a recording apparatus equipped with an intermediate transfer mechanism, in which printing is performed on an intermediate with a recording material (an ink), followed by transfer of an image on the intermediate onto a recording medium such as paper, or the like. Description will be given of a preferable image forming apparatus applied to an image forming method of the invention (an image forming apparatus of the invention).

An image forming apparatus of the invention includes: a recording head for at least one ink expelling the at least one ink to perform printing on a recording medium; plural recording heads for a liquid composition expelling the liquid composition having a function to cohere the at least one ink to perform printing on deposits of the at least one ink printed on the recording medium, wherein the recording heads for the liquid composition are installed on both end sides of the recording head for the at least one ink along a main scanning direction. Note that the above configuration means that in an image forming apparatus of the invention, in the case where plural ink recording head are used, the liquid composition recording heads are installed on both end sides thereof arranged, for example, in parallel to the main scanning direction.

In an image forming apparatus of the invention, the recording heads (carriage) are reciprocated in a direction (a main scanning direction) intersecting with a feed direction (a secondary scanning direction) to form an image, wherein in a forward transit, printing at first is performed with the inks from the ink recording heads and thereafter, printing is performed with the liquid composition from the liquid composition, recording head installed on at least one end of the ink recording heads. Furthermore, in a return transit as well, printing is at first performed with the inks from the ink recording heads in a similar way and thereafter, printing is performed with the liquid composition from the liquid composition recording head installed on at least one end of the ink recording heads. In such a way, in both of forward and return transits, after printing is performed with the inks in at least two colors on the recording medium, printing is further performed with the liquid composition on the recording medium to enable an image including a pattern in at least a secondary color to be formed. For this reason, reduction is achieved on color unevenness, optical density unevenness, bleeding, inter-color bleeding, drying time and the like together with resulted excellency in high speed applicability.

Detailed description will be given of a preferable embodiment of an image forming apparatus of the invention with reference to the accompanying drawings. Note that in the figures, the same or corresponding constituents are attached by the same marks and duplicated description is omitted.

Figure 2:
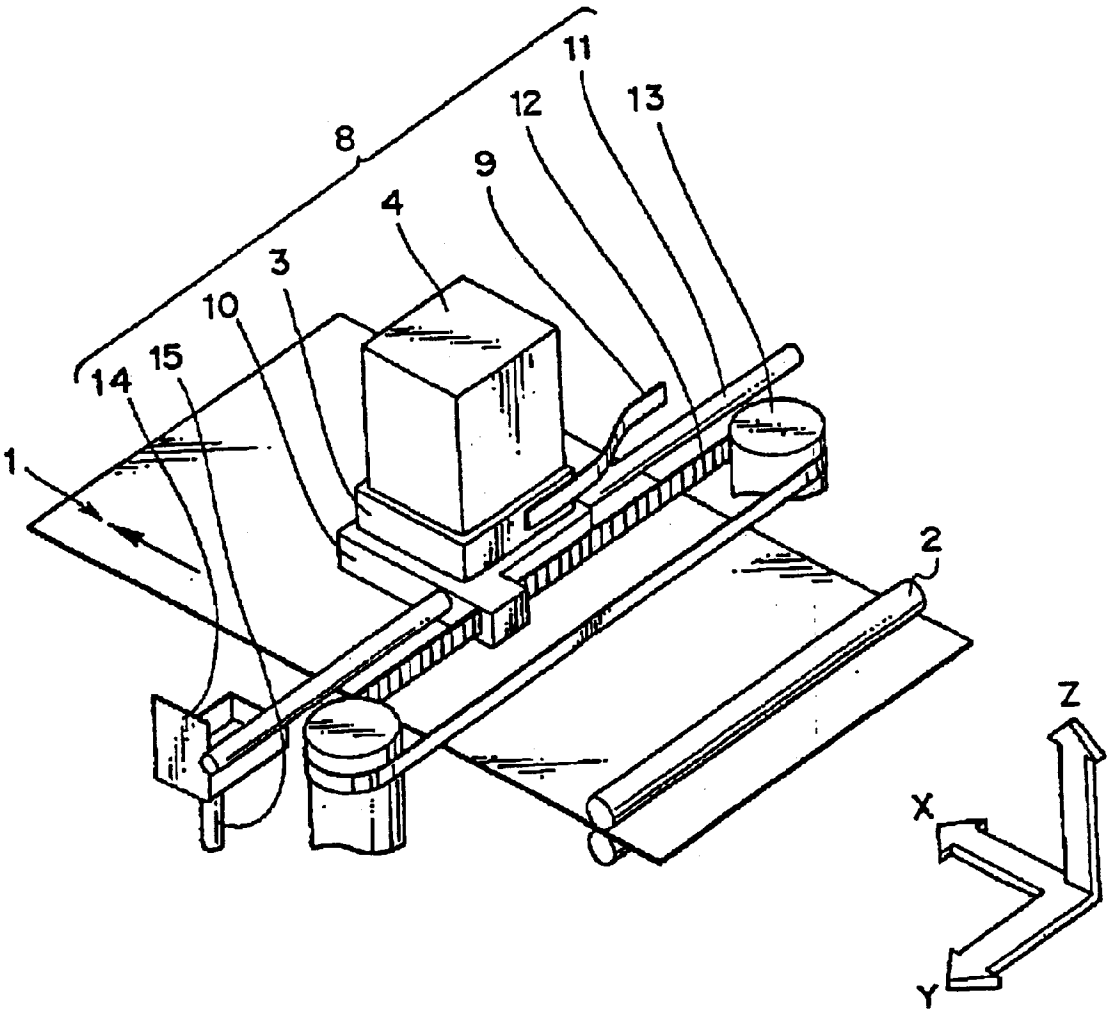
FIG. 2 is a perspective view showing a fundamental inner construction in the image forming apparatus of FIG. 1.

FIG. 1 is a perspective view showing a construction of outer appearance of a suitable embodiment of an image forming apparatus of the invention. FIG. 2 is a perspective view showing a fundamental inner construction in the image forming apparatus of FIG. 1. An image forming apparatus 100 of the invention is operable based on an image forming method (an ink-jet recording technique) of the invention described above and has a construction forming an image. That is to say, as shown in FIGS. 1 and 2, the image forming apparatus 100 is constituted mainly of: an exterior cover 6; a tray 7 capable of being loaded with a predetermined amount of a recording medium 1 such as plain paper sheets; feed rollers 2 (feed means) for feeding the recording medium 1 into the image forming apparatus 100 one sheet at a time; and an image forming section 8 (image forming means) expelling inks and a liquid composition to form an image on a surface of the recording medium 1.

The feed rollers 2 are a pair of rollers rotatably provided in the image forming apparatus 100 and not only hold by pressing the recording medium 1 set on the tray 7 from both sides, but also feed a predetermined amount of the recording medium 1 one at a time into the apparatus 100 at predetermined timings.

The image forming section 8 forms an image with the inks on the surface of the recording medium 1. The image forming section 8 is constructed mainly of: a recording head 3; an ink tank 4; a power supply signal cable 9; a carriage 10; a guide rod 11; a timing belt 12; a drive pulley 13; and a maintenance station 14.

Figure 3A:
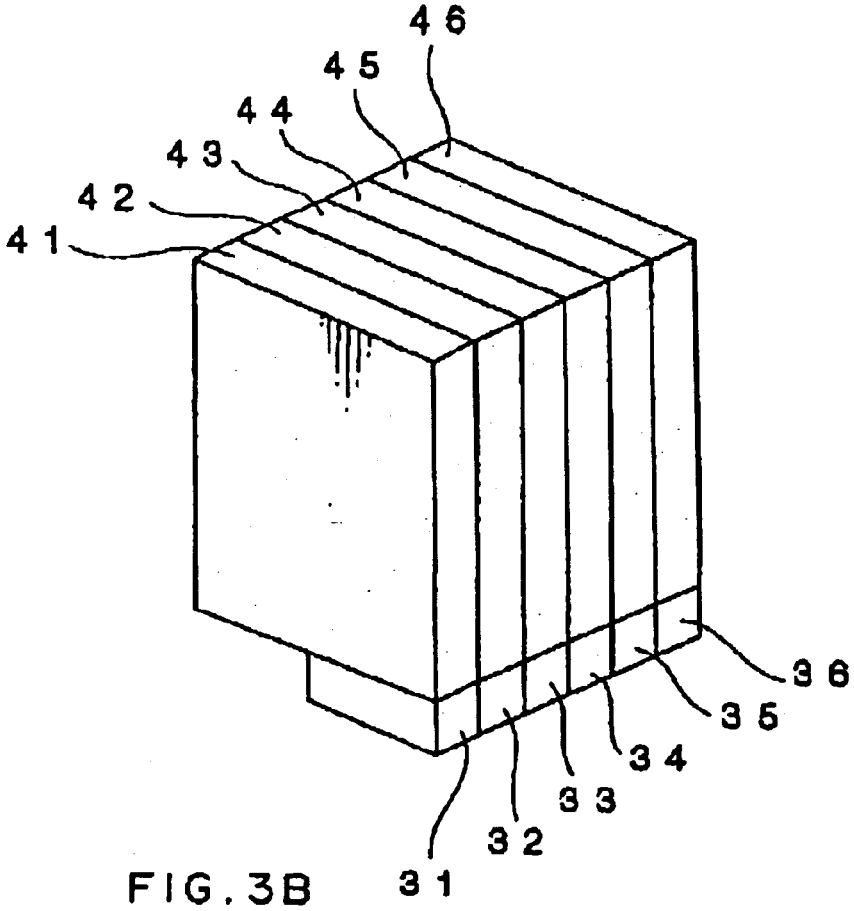
FIG. 3A is a detailed view of a recording head 3 and an ink tank 4 of FIG. 2.
Figure 3B:
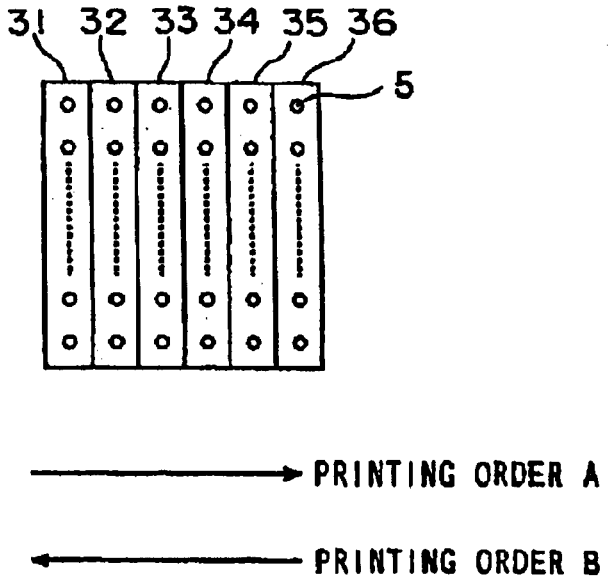
FIG. 3B is a plan view of the recording head 3 of FIG. 2.

FIG. 3A is a detailed view of the recording head 3 and the ink tank 4 of FIG. 2. FIG. 3B is a plan view of the recording head 3 of FIG. 2. As shown in FIG. 3A, the ink tank 4 including, as sub-tanks, ink tanks 41, 42, 43, 44, 45 and 46 holding inks in respective different colors and a liquid composition so as to be expellable and the recording heads 31, 32, 33, 34, 35 and 36 are connected to respective tanks. The recording heads 31, 32, 33, 34, 35 and 36 are arranged in parallel to a direction Y (a primary scanning direction) perpendicular to a feed direction X (a secondary scanning direction) of the recording medium 1. Furthermore, as shown in FIG. 3B, nozzles 5 expelling the inks and the liquid composition are provided on the recording head 3. The recording heads 31 and 36, and the ink tanks 41 and 46 are used for spouting the liquid composition. On the other hand, the recording heads 32, 33, 34 and 35, and the ink tanks 42, 43, 44 and 45 are used for printing with the inks in different colors. That is to say, the recording heads 31 and 36 spouting the liquid composition (liquid composition recording heads) are located at both end sides of the recording heads 32, 33, 34 and 35 (the ink recording heads) performing printing with the inks and the ink tanks 41 and 46 are located at both end sides of the ink tanks 42, 43, 44 and 45 (at both end sides of the ink recording heads arranged in parallel with the main scanning direction).

In addition, as shown in FIG. 2, the power supply signal cable 9 and the ink tank 4 are connected to the recording head 3 and when external image recording information is inputted to the recording head 3 from the power supply signal cable 9, the recording head 3 sucks and expels a predetermined amount of each ink from a corresponding tank based on the image recording information onto the surface of the recording medium. Note that the power supply signal cable 9 plays a role to supply power necessary for driving the recording head 3 in addition to supply the image forming information.

Furthermore, the recording head 3 is placed on and supported by the carriage 10 and the carriage 10 are connected to the guide rod 11 and the timing belt 12 connected to the driving pulley 13. With such a construction adopted, the recording head 3 can also move along the guide rod 11 in the direction Y (the main scanning direction) in parallel to the surface of the recording medium 1 on which powder is present in a scattered state and perpendicular to the feed direction X (the secondary scanning direction). That is to say, by rotating the driving pulley 13 stepwise at predetermined timings based on image recording information, the carriage 10 on which the recording head 3 is mounted is driven along the guide rod 11 via the timing belt 12, that is to say, the carriage 10 moves in reciprocation in the direction Y (the main scanning direction) perpendicular to the feed direction X (the secondary scanning direction) of the recording medium 1 (driving in a direction of the printing order A or B of FIG. 3) and an image is formed in a predetermined region on the surface of the recording medium 1.

In the case where printing is performed in the direction of the printing order A of FIG. 3, the inks are expelled from the recording heads 32, 33, 34 and 35 in the order to deposit droplets onto the recording medium 1, followed by expelling the liquid composition from the recording head 36 to apply the liquid composition onto adhered inks to form an image. On the other hand, in the case where printing is performed in the direction of the printing order B, the inks are expelled from the recording heads 35, 34, 33 and 32 in the order to deposit the inks onto the recording medium 1, followed by expelling the liquid composition from the recording head 31 to apply the liquid composition onto adhered inks to form an image. In such a way, on both cases of the printing orders A and B (forward and return transits), the liquid composition is adhered onto inks (on the recording medium) after adhesion of the ink droplets of the inks onto the recording medium 1.

The image forming apparatus 100 is equipped with control means (not shown) adjusting driving timings of the recording head 3 and driving timings of the carriage 10. With the control means, an image based on image recording information can be formed continuously in a predetermined region on the surface of the recording medium 1 fed at a predetermined speed in the feed direction X.

The maintenance station 14 is connected to a pressure-reducing device (not shown) via a tube 15. Moreover, the maintenance station 14 is connected to a nozzle portion of the recording head 3 and has a function to suck the inks from the nozzles of the recording head 3 by causing the interior of each nozzle to be in a reduced pressure condition. With the maintenance station 14 provided, unnecessary ink adhered to a nozzle during operation of the image forming apparatus 100 can be removed as necessary and evaporation of an ink from a corresponding nozzle can be suppressed during a state out of operation.

In an image forming apparatus 100 of this embodiment, since the recording heads 31 and 36 spouting the liquid composition are located at both end sides of the recording heads 32, 33, 34 and 35 performing printing with the inks and the ink tanks 41 and 46 are located at both end sides of the ink tanks 42, 43, 44 and 45, it is possible that the inks are expelled from the ink recording head in both of forward and return transits (the directions of the printing orders A and B of FIG. 3) to adhere ink droplets onto the recording medium and thereafter, the liquid composition can be applied onto inks adhered on the recording medium from the liquid composition recording head while forming an image in reciprocating of the recording head 3 along the direction Y (the main scanning direction) perpendicular to the feed direction X (the secondary scanning direction) of the recording medium 1. Hence, reduction is achieved on color unevenness, optical density unevenness, bleeding, inter-color bleeding, a drying time and the like caused by the printing order together with resulted excellency in high speed adaptability.

While detailed description has been given of one preferable embodiment of an image forming apparatus of the invention, the invention is not limited to the above described embodiment.

EXAMPLES

More specific description will be given of the invention presenting examples. It should be understood that the examples are not given by way of limitation of the present invention.

[Ink Preparation]

Inks each are prepared by adding a water-soluble organic solvent, a surfactant, ionic exchange water and other to a proper amount of a colorant solution so as to include the materials at respective predetermined amounts according to table 1 to 5. The mixture is further blended and stirred, followed by filtering with a 1 μm filter to obtain desired inks (TL-1 to 5 are liquid compositions). Note that in the case where pigments are used as colorants, desired inks are prepared using pigment dispersions subjected to pigment dispersion treatments 1 and 2 shown below. The pigment dispersion treatment 2 is a treatment in the case where a pigment self-dispersible in water is used and the pigment dispersion treatment 1 is a treatment in the case where a pigment other than the pigment self-dispersible in water is used.

Pigment Dispersion Treatment 1

A liquid including 30 parts by mass, 3 parts by mass of a high molecular dispersant as a dispersant and in addition thereto, 267 parts by mass of ion-exchange water is dispersed with a supersonic homogenizer. This dispersion is subjected to a centrifugal separation treatment (8000 rpm× 30 min) with a centrifugal separator to obtain 200 parts by mass of a supernatant liquid. The supernatant liquid is filtered to obtain a pigment dispersion.

Pigment Dispersion Treatment 2

A pigment self-dispersible in water is dispersed in ion-exchange water and the dispersion is subjected to a centrifugal separation treatment (8000 rpm×30 min) to obtain a pigment dispersion as an 80% of a total mass.

TABLE 1

| K-1 | | | |
|---|---|---|---|
| Black Pearls (made by Cabot Corporation) | 4 | parts by mass | pigment |
| Styrene-methacyrlic acid copolymer | 0.4 | parts by mass | high molecular dispersant |
| Thiodiethanol | 10 | parts by mass | water-soluble solvent |
| Diethylene glycol | 10 | parts by mass | water-soluble solvent |
| Isopropyl alcohol | 3 | parts by mass | water-soluble solvent |
| Urea | 5 | parts by mass | spouting property control |
| Polyoxyethylene 2-ethylhexyl ether | 0.1 | parts by mass | surfactant |
| Ion-exchange water | 67.5 | parts by mass | — |
| Rate of change over time in contact angle | | | 1.5 |
| Surface tension | | | 32 mN/m |
| Viscosity | | | 2.5 mPa · s |

TABLE 2

| C-1 | | | |
|---|---|---|---|
| IJX253 (made by Cabot Corporation) | 3.5 | parts by mass | pigment |
| Diethylene glycol | 15 | parts by mass | water-soluble solvent |
| Glycerin | 5 | parts by mass | water-soluble solvent |
| Isopropyl alcohol | 2.5 | parts by mass | water-soluble solvent |
| 2-ethylhexylmethacrylate-methacrylic acid copolymer | 0.5 | parts by mass | surfactant |
| Surfinol465 (made by Nisshin Chemicals Co., Ltd.) | 0.05 | parts by mass | surfactant |
| Urea | 4.5 | parts by mass | spouting property control |
| Ion-exchange water | 69.0 | parts by mass | — |
| Rate of change over time in contact angle | | | 1.8 |
| Surface tension | | | 33 mN/m |
| Viscosity | | | 2.4 mPa · s |
| C-2 | | | |
| C. I. Direct Blue 199 | 2.2 | parts by mass | dye |
| Diethylene glycol | 15 | parts by mass | water-soluble solvent |
| Propylene glycol | 5 | parts by mass | water-soluble solvent |
| Isopropyl alcohol | 3 | parts by mass | water-soluble solvent |
| Polyoxyethylene cetyl ether | 0.1 | parts by mass | surfactant |
| Urea | 4 | parts by mass | spouting property control |
| N,N'-bis(2-hydroxyethyl)-2-aminoethane sulfonic acid | 1.2 | parts by mass | a control agent |
| Sodium hydroxide | 0.6 | parts by mass | a control agent |
| Ion-exchange water | 68.9 | parts by mass | — |
| Rate of change over time in contact angle | | | 2.4 |
| Surface tension | | | 31 mN/m |
| Viscosity | | | 2.1 mPa · s |
| C-3 | | | |
| IJX253 (made by Cabot Corporation) | 3.5 | parts by mass | pigment |
| Diethylene glycol | 10 | parts by mass | water-soluble solvent |
| Glycerin | 10 | parts by mass | water-soluble solvent |
| Isopropyl alcohol | 2.5 | parts by mass | water-soluble solvent |
| Surfinol465 (made by Nisshin Chemicals Co., Ltd.) | 1 | part by mass | surfactant |
| Urea | 4.5 | parts by mass | spouting property control |
| Ion-exchange water | 68.5 | parts by mass | — |
| Rate of change over time in contact angle | | | 8.7 |
| Surface tension | | | 33 mN/m |

TABLE 2-continued

| | | |
|---|---|---|
| Viscosity | 2.4 mPa · s | |
| C-4 | | |
| IJX253 (made by Cabot Corporation) | 3.5 parts by mass | pigment |
| Diethylene glycol | 10 parts by mass | water-soluble solvent |
| Sulforan | 10 parts by mass | water-soluble solvent |
| Isopropyl alcohol | 2.5 parts by mass | water-soluble solvent |
| Urea | 4.5 parts by mass | spouting property control |
| Ion-exchange water | 69.5 parts by mass | — |
| Rate of change over time in contact angle | 1.0 | |
| Surface tension | 44 mN/m | |
| Viscosity | 2.2 mPa · s | |

TABLE 3

| | | |
|---|---|---|
| M-1 | | |
| IJX266 (made by Cabot Corporation) | 4.5 parts by mass | pigment |
| Glycerin | 10 parts by mass | water-soluble solvent |
| Ethylene glycol | 10 parts by mass | water-soluble solvent |
| Urea | 4 parts by mass | spouting property control |
| Styrene-methacrylic acid copolymer | 0.1 parts by mass | surfactant |
| Ion-exchange water | 71.4 parts by mass | — |
| Rate of change over time in contact angle | 1.2 | |
| Surface tension | 32 mN/m | |
| Viscosity | 2.4 mPa · s | |
| M-2 | | |
| IJX266 (made by Cabot Corporation) | 4.5 parts by mass | pigment |
| Diethylene glycol | 20 parts by mass | water-soluble solvent |
| Isopropyl alcohol | 4 parts by mass | water-soluble solvent |
| Urea | 5 parts by mass | surfactant |
| SFN465 (made by Nisshin Chemicals Co., Ltd.) | 1 part by mass | spouting property control |
| Ion-exchange water | 65.5 parts by mass | — |
| Rate of change over time in contact angle | 5.5 | |
| Surface tension | 34 mN/m | |
| Viscosity | 2.3 mPa · s | |
| M-3 | | |
| IJX266 (made by Cabot Corporation) | 4.5 parts by mass | pigment |
| Diethylene glycol | 20 parts by mass | water-soluble solvent |
| Isopropyl alcohol | 4 parts by mass | water-soluble solvent |
| Urea | 5 parts by mass | surfactant |
| Ion-exchange water | 66.5 parts by mass | — |
| Rate of change over time in contact angle | 1.0 | |
| Surface tension | 46 mN/m | |
| Viscosity | 2.3 mPa · s | |

TABLE 4

| | | |
|---|---|---|
| Y-1 | | |
| IJX244 (made by Cabot Corporation) | 4 parts by mass | pigment |
| Diethylene glycol | 15 parts by mass | water-soluble solvent |
| Butyl carbitol | 5 parts by mass | water-soluble solvent |
| Urea | 6 parts by mass | spouting property control |
| Polyoxyethylene stearyl ether | 0.08 parts by mass | surfactant |
| Styrene-maleic acid copolymer | 0.2 parts by mass | surfactant |
| Ion-exchange water | 69.72 parts by mass | — |
| Rate of change over time in contact angle | 20 | |
| Surface tension | 32 mN/m | |
| Viscosity | 2.4 mPa · s | |
| Y-2 | | |
| SP4178 (made by Fuji Shikiso Co. Ltd.) | 4 parts by mass | pigment |
| Diethylene glycol | 8 parts by mass | water-soluble solvent |
| Sulforan | 8 parts by mass | water-soluble solvent |
| Urea | 5 parts by mass | spouting property control |
| Surfinol465 (made by Nisshin Chemicals Co., Ltd.) | 0.08 parts by mass | surfactant |
| n-Butylmethacrylate-methacrylic acid copolymer | 0.1 parts by mass | surfactant |
| Ion-exchange water | 74.82 parts by mass | — |

TABLE 4-continued

| | |
|---|---|
| Rate of change over time in contact angle | 1.9 |
| Surface tension | 31 mN/m |
| Viscosity | 2.3 mPa · s |

TABLE 5

| | | |
|---|---|---|
| TL-1 | | |
| Diethylene glycol | 10 parts by mass | water-soluble solvent |
| Propylene glycol | 10 parts by mass | water-soluble solvent |
| Surfinol465 (made by Nisshin Chemicals Co., Ltd.) | 0.8 parts by mass | surfactant |
| Magnesium nitrate | 4 parts by mass | cohesive agent |
| Ion-exchange water | 75.2 parts by mass | — |
| TL-2 | | |
| Ethylene glycol | 10 parts by mass | water-soluble solvent |
| Glycerin | 10 parts by mass | water-soluble solvent |
| Polyoxyethylene 2-ethylhexyl ether | 1 part by mass | surfactant |
| Calcium nitrate | 3 parts by mass | cohesive agent |
| Ion-exchange water | 76.0 parts by mass | — |
| TL-3 | | |
| Sulforan | 10 parts by mass | water-soluble solvent |
| Diethylene glycol | 10 parts by mass | water-soluble solvent |
| Polyoxyethylene 2-ethythexyl ether | 0.7 parts by mass | surfactant |
| Calcium nitrate | 3 parts by mass | cohesive agent |
| Polyallylamine | 2 parts by mass | cohesive agent |
| Ion-exchange water | 74.3 parts by mass | — |
| TL-4 | | |
| Diethylene glycol | 20 parts by mass | water-soluble solvent |
| Calcium nitrate | 3 parts by mass | cohesive agent |
| Ion-exchange water | 77.0 parts by mass | — |
| TL-5 | | |
| Diethylene glycol | 10 parts by mass | water-soluble solvent |
| Propylene glycol | 10 parts by mass | water-soluble solvent |
| Surfinol465 (made by Nisshin Chemicals Co., Ltd.) | 0.8 parts by mass | cohesive agent |
| Ion-exchange water | 79.2 parts by mass | — |

Examples 1 to 3, Comparative Examples 1 to 4

An ink set constituted of inks and liquid compositions shown in Table 6 are loaded in an experimental ink jet recording apparatus equipped with an experimental print head with specifications of 800 dpi and 256 nozzles, with a similar construction to the image forming apparatus 100 shown in FIGS. 1 to 3 to perform printing in forward and return transits in the printing order of A and B shown in FIG. 3 according a pattern shown below to form an image and evaluate the following evaluations. Note that in the following printing and evaluations, test specimens obtained by performing printing under a general environment (at a temperature 23±0.5° C. and a humidity of 55±5% RH) are stored under the general environment without doing nothing thereon for 24 hr unless otherwise specified. Results are also shown in Table 6. In Table 7, there are shown rates of change over time in contact angle and the number of coarse particles of 5 μm or more in diameter of mixed liquids of inks and liquid compositions (TL-1 to 5) used in Examples 1 to 3 and Comparative Examples 1 to 4.

Herein, sheets of plain paper (FX-L paper made by Fuji Xerox Co., Ltd.) are used as recording media. The liquid compositions TL-1 to 5 are charged into the ink tanks 41 and 46 and expelled from the recording heads 31 and 36 and other inks are loaded in the ink tanks 42, 43, 44 and 45 in a proper way and expelled from the recording heads 32, 33, 34 and 35 in a suitable way.

(Color Unevenness)

Printing is performed to obtain patterns of secondary color and colors higher in the order subsequent thereto according to the printing order of A and B shown in FIG. 3 and hues (a lightness L* and a chroma a*/b*) are measured using X-Rite 938 (made by X-Rite, Incorporated.). Note that ΔE deduced from the following formula is used as a criterion in judging a color unevenness. Criteria for evaluation are as follows:

Criteria for Evaluations

○: ΔE is less than 5.

Δ: ΔE falls 5 or more and less than 10.

×: ΔE is 10 or more.

$$\Delta E = \sqrt{(\Delta L^*)^2 + (\Delta a^*)^2 + (\Delta b^*)^2}$$

Herein, ΔL*, Δa* and Δb* show differences of L*, a* and b* of hue measurement results in the printing order A and B.

(Optical Density)

A pattern with 100% coverage is printed and an optical density is measured using X-Rite 404 (made by X-Rite Incorporated.). Criteria of evaluation are as follows.

Criteria for Evaluations of Black Ink

○: An optical density is 1.4 or more.

Δ: An optical density is 1.3 or more and less than 1.4.

×: An optical is less than 1.3.

Criteria for Evaluations of Color Ink

○: An optical density is 1.1 or more.

Δ: An optical density is 1.0 or more and less than 1.1.

×: An optical is less than 1.0.

(Inter-Color Bleeding)

Evaluation of inter-color bleeding is conducted with an organoleptic test in which adjacent patterns in different colors are printed and a degree of bleeding at a boundary portion is determined by comparing the bleeding on boundary samples, which are determined in advance. Criteria of evaluation are as follows.

Criteria for Evaluations

○: slight in bleeding.

Δ: Bleeding is recognized at an allowable level.

×: great in bleeding beyond an allowable level.

(Bleeding)

Evaluation of bleeding is conducted with an organoleptic test in which a fine line pattern is printed and a degree of bleeding at a print portion is determined by comparing the bleeding on boundary samples. Criteria of evaluation are as follows.

Criteria for Evaluations ○: slight in bleeding.

Δ: Bleeding is recognized at an allowable level.

×: great in bleeding in excess of an allowable level (Drying Time)

A pattern with 100% coverage is printed and after a predetermined time elapses, the printed pattern is pressed on another FX-L paper sheet with a load of $1.9\times10^4$ N/m$^2$. At this time, a time is measured as a drying time at least in which inks of the pattern is transferred to the pressed FX-L paper sheet side no longer. Criteria of evaluation are as follows.

Criteria for Evaluations

○: A drying time is less than 3 sec.

Δ: A drying time is 3 sec or more and less than 10 sec.

×: A drying time is 10 sec or more.

TABLE 6

| Ink set | Average of rates of change over time in contact angle of all inks (degrees/sec) | | Rate of change over time in contact angle of each ink (degrees/sec) | | Rate of change over time in contact angle of mixed liquid (degrees/sec) | | Number of coarse particles in mixed liquid (particles/μL) | |
|---|---|---|---|---|---|---|---|---|
| Example 1 | | | | | | | | |
| K-1<br>C-1<br>M-1<br>Y-1<br>TL-1 | ○ | 1.6 | ○ | 1.2~2.0 | ○ | 6.2~6.5 | ○ | $1.8\times10^4$~$1.2\times10^6$ |
| Example 2 | | | | | | | | |
| C-1<br>Y-2<br>TL-2 | ○ | 1.9 | ○ | 1.8~1.9 | ○ | 5.3 | ○ | $2.5\times10^4$~$4.4\times10^4$ |
| Example 3 | | | | | | | | |
| C-2<br>Y-1<br>TL-3 | ○ | 2.2 | ○ | 2.0~2.4 | ○ | 5.5~5.6 | ○ | $1.7\times10^4$~$2.4\times10^4$ |
| Comparative Example 1 | | | | | | | | |
| C-1<br>Y-1<br>TL-4 | ○ | 1.9 | ○ | 1.8~2.0 | X | 1.7~1.8 | ○ | $1.6\times10^4$~$4.8\times10^4$ |
| Comparative Example 2 | | | | | | | | |
| C-3<br>M-2<br>TL-1 | X | 7.1 | X | 5.5~8.7 | ○ | 9.2~9.3 | X | $0.8\times10^4$~$10.9\times10^4$ |
| Comparative Example 3 | | | | | | | | |
| C-1<br>Y-1<br>TL-5 | ○ | 1.9 | ○ | 1.8~2.0 | ○ | 8.6~8.7 | X | $0.2\times10^4$~$0.3\times10^4$ |
| Comparative Example 4 | | | | | | | | |
| C-4<br>M-3<br>TL-5 | X | 1.0 | ○ | 1.0~1.0 | ○ | 7.8 | X | $0.2\times10^4$ |

| Ink set | Color uneveness | Optical density | Bleeding | Inter-color bleeding | Drying time |
|---|---|---|---|---|---|
| Example 1 | | | | | |
| K-1<br>C-1<br>M-1<br>Y-1 | ○ | ○ | ○ | ○ | ○ |

TABLE 6-continued

| | | | | | |
|---|---|---|---|---|---|
| TL-1<br>Example 2 | | | | | |
| C-1<br>Y-2<br>TL-2<br>Example 3 | ○ | ○ | ○ | ○ | ○ |
| C-2<br>Y-1<br>TL-3<br>Comparative<br>Example 1 | ○ | ○ | ○ | ○ | ○ |
| C-1<br>Y-1<br>TL-4<br>Comparative<br>Example 2 | X | ○ | ○ | ○ | X |
| C-3<br>M-2<br>TL-1<br>Comparative<br>Example 3 | X | X | X | ○ | ○ |
| C-1<br>Y-1<br>TL-5<br>Comparative<br>Example 4 | ○ | X | Δ | Δ | X |
| C-4<br>M-3<br>TL-5 | X | X | Δ | Δ | ○ |

Herein, mixed liquids mean mixed liquids of each ink and a coresponding liquid composition (TL-1 to 5)

TABLE 7

| | Kinds of mixed liquid | | | | | |
|---|---|---|---|---|---|---|
| | Ink | Treatment liquid | Change rate in contact angle of mixed liquid (degrees/sec) | | Number of coarse particles in mixed liquid (particles/μL) | |
| Example 1 | K-1 | TL-1 | ○ | 6.2 | ○ | $1.2 \times 10^5$ |
| | C-1 | TL-1 | ○ | 6.3 | ○ | $5.1 \times 10^4$ |
| | M-1 | TL-1 | ○ | 6.2 | ○ | $1.8 \times 10^4$ |
| | Y-1 | TL-1 | ○ | 6.5 | ○ | $2.2 \times 10^4$ |
| Example 2 | C-1 | TL-2 | ○ | 5.3 | ○ | $4.4 \times 10^4$ |
| | Y-2 | TL-2 | ○ | 5.3 | ○ | $2.5 \times 10^4$ |
| Example 3 | C-2 | TL-3 | ○ | 5.6 | ○ | $1.7 \times 10^4$ |
| | Y-1 | TL-3 | ○ | 5.5 | ○ | $2.4 \times 10^4$ |
| Comparative | C-1 | TL-4 | X | 1.8 | ○ | $4.8 \times 10^4$ |
| Example 1 | Y-1 | TL-4 | X | 1.7 | ○ | $1.6 \times 10^4$ |
| Comparative | C-3 | TL-1 | ○ | 9.3 | X | $0.9 \times 10^4$ |
| Example 2 | M-2 | TL-1 | ○ | 9.2 | X | $0.8 \times 10^4$ |
| Comparative | C-1 | TL-5 | ○ | 8.6 | X | $0.3 \times 10^4$ |
| Example 3 | Y-1 | TL-5 | ○ | 8.7 | X | $0.2 \times 10^4$ |
| Comparative | C-4 | TL-5 | ○ | 7.8 | X | $0.2 \times 10^4$ |
| Example 4 | M-3 | TL-5 | ○ | 7.8 | X | $0.2 \times 10^4$ |

According to the invention, as described above, there can be provided an image forming method excellent in reduction in color unevenness, optical density unevenness, bleeding, inter-color bleeding and a drying time and an image forming apparatus excellent in high speed adaptability.

What is claimed is:

1. An image forming method comprising the steps of:

printing at least two colors of ink onto a recording medium using an ink-set, which satisfies the below conditions (i) to (iv) and includes the at least two colors of ink and a liquid composition including an effect of cohering the at least two colors of ink; and forming an image, which includes a pattern of at least a secondary color, by printing the liquid composition on the printed ink, wherein (i) an average value of rates of change over time in contact angle of the respective inks on plain paper is at least 1.25 degrees/sec and no more than 3.5 degrees/sec, (ii) a rate of change over time for a contact angle of each ink on plain paper is less than 4.5 degrees/sec, (iii) a rate of change over time for a contact angle of a mixture of each ink and the liquid composition on plain paper is in the range of from 5 to 10 degrees/sec and (iv) the number of coarse particles, which have a diameter of at least 5 μm, in the mixture is at least $1\times10^4$ particles/μL.

2. An image forming method according to claim 1, wherein a surface tension of each of the inks is at least 25 mN/m and no more than 40 mN/m.

3. An image forming method according to claim 1, wherein a viscosity of each of the inks is at least 1.5 mPa·s and no more than 6.0 mPa·s.

4. An image forming method according to claim 1, wherein a recording head reciprocates along a direction intersecting with a conveyance direction of the recording medium to form an image by adhering the at least two colors of ink on the recording medium, and prints in both forward transit and return transit with the at least two colors of ink, and then prints the liquid composition on the ink printed on the recording medium to form the image including a pattern of at least a secondary color.

5. An image forming method according to claim 1, wherein an image is formed with a thermal ink-jet technique.

6. An image forming apparatus comprising:

an ink set, which satisfies the below conditions (i) to (iv) and includes at least two colors of ink and a liquid composition including an effect of cohering the at least two colors of ink;

an ink recording head for printing at least one color of ink, by discharging the at least one color of ink onto a recording medium;

a plurality of liquid composition recording heads for printing the liquid composition on the printed ink, wherein the liquid composition heads are disposed at both ends of the ink recording head in a main scanning direction of the ink recording head, and (i) an average value of rates of change over time in contact angle of the respective inks on plain paper is at least 1.25 degrees/sec and no more than 3.5 degrees/sec, (ii) a rate of change over time for a contact angle of each ink on plain paper is less than 4.5 degrees/sec, (iii) a rate of change over time for a contact angle of a mixture of each ink and the liquid composition on plain paper is in the range of from 5 to 10 degrees/sec and (iv) the number of coarse particles, which have a diameter of at least 5 μm, in the mixture is at least $1\times10^4$ particles/μL.

7. An image forming apparatus according to claim 6, wherein a surface tension of each of the inks is at least 25 mN/m and no more than 40 mN/m.

8. An image forming apparatus according to claim 6, wherein a viscosity of each of the inks is at least 1.55 mPa·s and no more than 6.0 mPa·s.

9. An image forming apparatus according to claim 6, wherein the image forming apparatus reciprocates along a direction intersecting with a conveyance direction of the recording medium to form an image by adhering the at least two colors of ink on the recording medium, and prints in both forward transit and return transit, then prints the liquid composition on the ink printed on the recording medium to form an image including a pattern of at least a secondary color.

10. An image forming apparatus according to claim 6, wherein the image is formed with a thermal ink-jet technique.

11. A set of inks and liquid composition, wherein the inks satisfy the below conditions (i) to (iv) and includes the at least two colors of ink and a liquid composition including an effect of cohering the at least two colors of ink, (i) an average value of rates of change over time in contact angle of the respective inks on plain paper is at least 1.25 degrees/sec and no more than 3.5 degrees/sec, (ii) a rate of change over time for a contact angle of each ink on plain paper is less than 4.5 degrees/sec, (iii) a rate of change over time for a contact angle of a mixture of each ink and the liquid composition on plain paper is in the range of from 5 to 10 degrees/sec and (iv) the number of coarse particles, which have a diameter of at least 5 μm, in the mixture is at least $1\times10^4$ particles/μL.

12. A set of inks and a liquid composition according to claim 11, wherein a surface tension of each of the inks is at least 25 mN/m and no more than 40 mN/m.

13. A set of inks and a liquid composition according to claim 11, wherein a viscosity of each of the inks is at least 1.5 mPa·s and no more than 6.0 mPa·s.

* * * * *